US005699584A

United States Patent [19]

Wieloch et al.

[11] Patent Number: 5,699,584

[45] Date of Patent: Dec. 23, 1997

[54] WEB SYSTEM

[75] Inventors: Francis J. Wieloch, Penfield; Gina M. LaManna, Ontario; Frank J. Jackson, Jr., Rochester; Gary W. Smallman, Fairport; Kenneth A. Kemp, Walworth; Edward J. Speakman, Ontario; Edward F. Grabowski, Webster; Terry L. Street, Fairport; Carl A. Wisniewski, Rochester; John A. Czerniawski, Webster, all of N.Y.

[73] Assignee: Xerox Corporation, Stamford, Conn.

[21] Appl. No.: 505,927

[22] Filed: Jul. 24, 1995

[51] Int. Cl.[6] ..... B08B 1/02; B08B 1/04; G03G 21/00

[52] U.S. Cl. ..... 15/256.52; 15/3; 15/102; 15/256.5; 15/256.51

[58] Field of Search ..... 15/3, 100, 102, 15/103.5, 256.5, 256.51, 256.52, 256.53, 256.6

[56] References Cited

U.S. PATENT DOCUMENTS

| | | | |
|---|---|---|---|
| 1,949,868 | 3/1934 | Keuffel | 15/100 |
| 2,322,986 | 6/1943 | Weiss et al. | 15/102 X |
| 4,116,762 | 9/1978 | Gardiner | 15/302 X |
| 4,145,231 | 3/1979 | Heckman | 15/103.5 X |
| 4,704,803 | 11/1987 | Valentini | 15/256.5 X |
| 4,949,133 | 8/1990 | Landa | 15/256.5 X |
| 5,251,348 | 10/1993 | Corrado et al. | 15/256.53 |
| 5,275,104 | 1/1994 | Corrado et al. | 101/425 |
| 5,425,813 | 6/1995 | Ernest et al. | 15/256.5 X |

*Primary Examiner*—Mark Spisich

[57] ABSTRACT

A system for cleaning a substrate comprising bringing a contact cleaning web into moving synchronous contact with the surface of a member to be cleaned to clean the surface.

13 Claims, 5 Drawing Sheets

WEB SYSTEM

BACKGROUND OF THE INVENTION

This invention relates in general to cleaning systems and more specifically, to web apparatus and process for cleaning objects.

In the art of electrophotography an electrophotographic plate comprising a photoconductive insulating layer on a conductive layer is imaged by first uniformly electrostatically charging the imaging surface of the photoconductive insulating layer. The plate is then exposed to a pattern of activating electromagnetic radiation such as light, which selectively dissipates the charge in the illuminated areas of the photoconductive insulating layer while leaving behind an electrostatic latent image in the non-illuminated area. This electrostatic latent image may then be developed to form a visible image by depositing finely divided electroscopic toner particles on the surface of the photoconductive insulating layer. The resulting visible toner image can be transferred to a suitable receiving member such as paper. This imaging process may be repeated many times with reusable photoconductive insulating layers.

Multilayered photoreceptors usually comprise a substrate, a conductive layer, an optional hole blocking layer, an optional adhesive layer for flexible photoreceptors, a charge generating layer, and a charge transport layer and, in some embodiments, an anti-curl backing layer for flexible photoreceptor.

Although excellent toner images may be obtained with multilayered photoreceptors, it has been found that as more advanced, higher speed electrophotographic copiers, duplicators and printers were developed, the electrical and mechanical performance requirements have become more demanding. It has also been found that these electrical and mechanical performance requirements are not being met because of defects in one or more of the coated layers of the multilayered photoreceptors. These defects are caused by the presence of dirt particles on the substrate, conductive layer, optional hole blocking layer, optional adhesive layer, charge generating layer, charge transport layer and/or optional anti-curl backing layer. Thus for example, particles of dirt (particulate debris) residing on an uncoated or coated substrate surface during application of coatings to form an electrostatographic imaging member, such as a photoreceptor, can cause bubbles or voids to form in the various applied coating layers. It is believed that the dirt particles behave in a manner similar to a boiling chip which initiates solvent boiling at the location of the particle. This local boiling problem is aggravated when a coating solution is maintained near the boiling point of the coating solvent during deposition of the coating or during drying. The formation of bubbles in a coating is particularly acute in photoreceptor charge generation layer coatings and in charge transport layer coatings. Also, dirt particles tend to trap air during application of a coating and the trapped air expands during drying to form an undesirable bubble in the coating.

Further, any dirt particles residing on one or both major surfaces of an electrophotographic imaging member web substrate can adversely affect adjacent surfaces when the web is rolled up into a roll because the dirt particles cause impressions on the adjacent web surfaces. Because these undesirable impressions can be repeated through more than one overlapping web layer, large sections of a coated web must be scrapped. Where large belts, e.g. ten pitch belts, are to be fabricated, a 10 percent defect rate for a single pitch can result in the discarding of 60 to 70 percent of the entire web because very large expanses of defect free surfaces are required for such large belts.

The sources of the dirt particles include transporting systems, coating systems, drying systems, cooling systems, slitting systems, winding and unwinding systems for belts, debris from the electrophotographic imaging member web or drum substrate itself, workers, and the like.

In relatively thin charge blocking layers, such as organopolysiloxane layers, any dirt particles present on the web or drum substrate surface tends to lift the coating layer and cause local coating voids. This also occurs with relatively thin adhesive layers between a charge blocking layer and a charge generation layer in web photoreceptors. Usually, after a web substrate is coated with the charge blocking layer and adhesive layer, the coated web substrate is rolled up into a roll and transported to another coating station. During unrolling or unwinding of the coated web, static electricity is generated as the outermost ply of the coated web is separated from the roll. This static electricity tends to attract dirt particles to the exposed surfaces of the web.

It has been found that brushing, buffing or other cleaning systems which physically contact the delicate and fragile surfaces of a coated or uncoated electrophotographic imaging member web substrate can cause undesirable scratches in the delicate outer surface of the substrate even if the contact systems are employed in conjunction with electrostatic discharge bars. Cleaning systems that do not contact the coated or uncoated electrophotographic imaging member web substrate, such as air knives and vacuum systems, whether or not assisted with electrostatic discharge bars, are not capable of removing small particles, those having an average particle size of less than about 100 micrometers to 30 micrometers range due to electrostatic attraction and a thin protective inertial air boundary layer on the substrate surface.

The use of a contact cleaner roll making continuous rolling contact with a moving web can remove loose particles of contamination from the web. As the web moves over the cleaner roll, the loose particulate matter is transferred from the web to the cleaner roll which is somewhat adhesive or tacky. As this transfer process continues, the transferred contaminants accumulate on the surface of the cleaner roll. The cleaner roll itself becomes contaminated and is replaced or cleaned periodically to restore its effectiveness. This is typically done by shutting down the system or process, retracting the cleaner roll, and washing and drying it manually. To avoid down time of the system or process, these contact cleaner rolls can be cleaned without interrupting the continuous movement of web through the apparatus by a device for sequential cleaning of the contact cleaner rolls. This type of contact cleaner roll system is disclosed, for example, in U.S. Pat. No. 5,251,348, the disclosure thereof being incorporated herein in its entirety.

INFORMATION DISCLOSURE STATEMENT

U.S. Pat. No. 5,251,348 to Corrado et al, issued Oct. 12, 1993—A contact cleaner roll cleaning system is described which includes a frame supporting the system relative to a moving web, a contact cleaner roll turret on the frame, and a roll cleaner on the frame. The turret supports two or more rotatable contact cleaner rolls, an active roll in rolling contact with the web, and an idle roll out of contact with the web for cleaning. The idle roll is kept rotating while it is idle and being cleaned. The turret is rotatable to sequentially put the cleaner rolls into and out of contact with the web. The roll cleaner includes an absorbent cleaning material mounted adjacent to the idle roll for placement against it and movement lengthwise along it to wipe it clean. Spindles advance the cleaning material between wipings of the idle roll, and a liquid delivery system keeps the cleaning material wet.

U.S. Pat. No. 5,275,104 to Corrado et al, issued Jan. 4, 1994—Apparatus is disclosed for cleaning a rotating process roll includes cleaning material supply and take-up rolls and a compliant touch roll, all mounted on a carriage adjacent to a process roll. Touch roll and cleaning material are movable by air cylinders into and out of contact with the process roll. The touch roll is rotatable in one direction only with the take-up roll. A drive motor winds the take-up roll to incrementally and uniformly advance the cleaning material over the touch roll. Period and frequency of the cleaning cycle and sub-cycles are variable by microprocessor control. Supply roll and take-up roll are supported in retractable gudgeons for easy mounting and removal.

Thus, there is a need for a system to produce high quality electrostatographic imaging members in higher yields by effectively removing dirt particles from coated or uncoated electrophotographic imaging member web or drum substrates.

SUMMARY OF THE INVENTION

It is, therefore, an object of the present invention to provide an improved cleaning system which overcomes the above-noted deficiencies.

It is yet another object of the present invention to provide an improved cleaning system which removes dirt particles having a very small average particle size from a web or drum.

It is still another object of the present invention to provide an improved cleaning system which prevents embossing of webs by dirt particles when the webs are wound.

It is another object of the present invention to provide an improved coated web or drum.

It is yet another object of the present invention to provide an improved cleaning system that prevents scratches from forming on a web or drum during cleaning.

It is still another object of the present invention to provide an improved cleaning system which can contact a greater area for cleaning.

The foregoing objects and others are accomplished in accordance with this invention by providing a system for cleaning a substrate including means for bringing a contact cleaning web into moving synchronous contact with the moving surface of a member to be cleaned to remove dirt particles.

BRIEF DESCRIPTION OF THE DRAWINGS

A more complete understanding of the process of the present invention can be obtained by reference to the accompanying drawings wherein.

The figures are merely schematic illustrations of the present invention. They are not intended to indicate the relative size and dimensions of a contact cleaning system or components thereof.

DETAILED DESCRIPTION OF THE DRAWINGS

Figure 1:
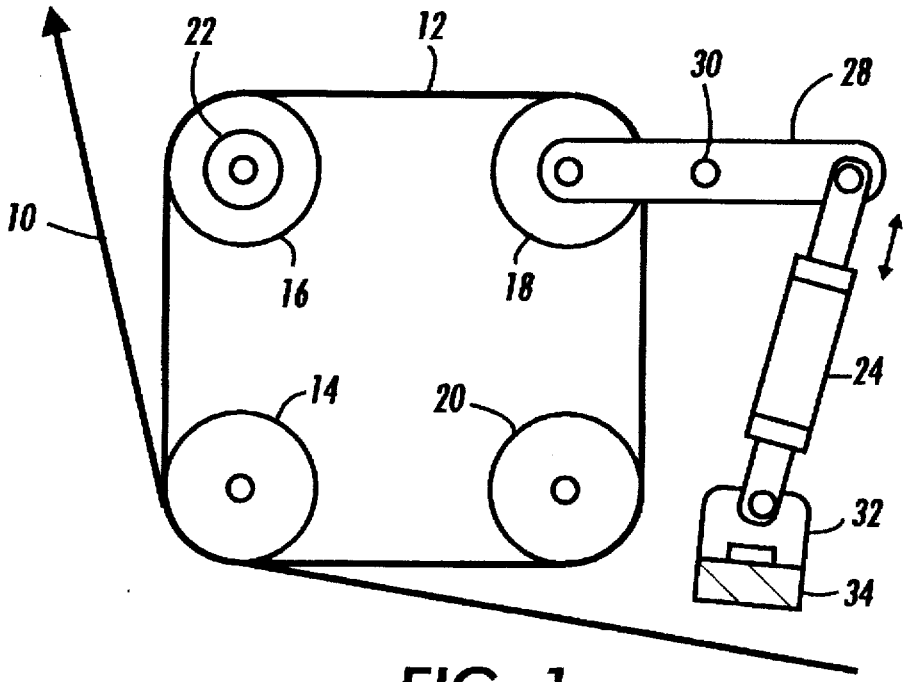
FIG. 1 is a schematic front elevation view of a contact cleaner belt system used to clean a web.

FIG. 1 shows a contact cleaner belt system of this invention in a web processing apparatus. The web processing apparatus is indicated by a web 10 generally moving from right to left to right in pressure contact with a continuous contact cleaning belt 12 supported by a series of rollers 14, 16, 18 and 20 which, in turn, have axial shafts supported on a frame (not shown). The contact cleaner belt is a flexible polymer film coated with a polymer for a tacky surface. The tacky surface of the contact cleaner belt 12 is in synchronized moving contact with a major surface of the moving web 10 to remove dirt particles of contamination from contacting surface of web 10 as it is pressed against the particles. Depending upon the amount of rotational friction encountered with rollers 14, 16, 18 and 20, it may be desirable to utilize speed match drive motor 22 to ensure synchronized moving contact of contact cleaning belt with web 10. Relative slippage between the contacting surfaces of web 10 and contact cleaning web 12 can cause undesirable scratches to form in either surface and embed dirt particles in either surface. The width of moving contact cleaning belt should be sufficient to span the width of moving web 10. When the contact cleaner belt 12 becomes become too contaminated with dirt particles for effectively cleaning web 10, it must be cleaned or replaced to restore its effectiveness. Removal of belt 12 may be effected by activation of two-way acting air cylinder 24 which pivots arm 28 counterclockwise around pin 30 to move roller 18 downwardly to provide slack in belt 12 for belt removal or installation. Pin 30 is supported by a frame (not shown) and two-way acting air cylinder 24 is supported by flange 32 which is secured to the frame 34. Two-way acting cylinder 24 is activated and inactivated by a conventional air and valving source (not shown). Activation of cylinder 24 rotates arm 28 counterclockwise around pin 30 Inactivation of two-way acting air cylinder 24 causes arm 28 to rotate clockwise to impart tension to belt 10 and facilitates tracking.

Figure 2:
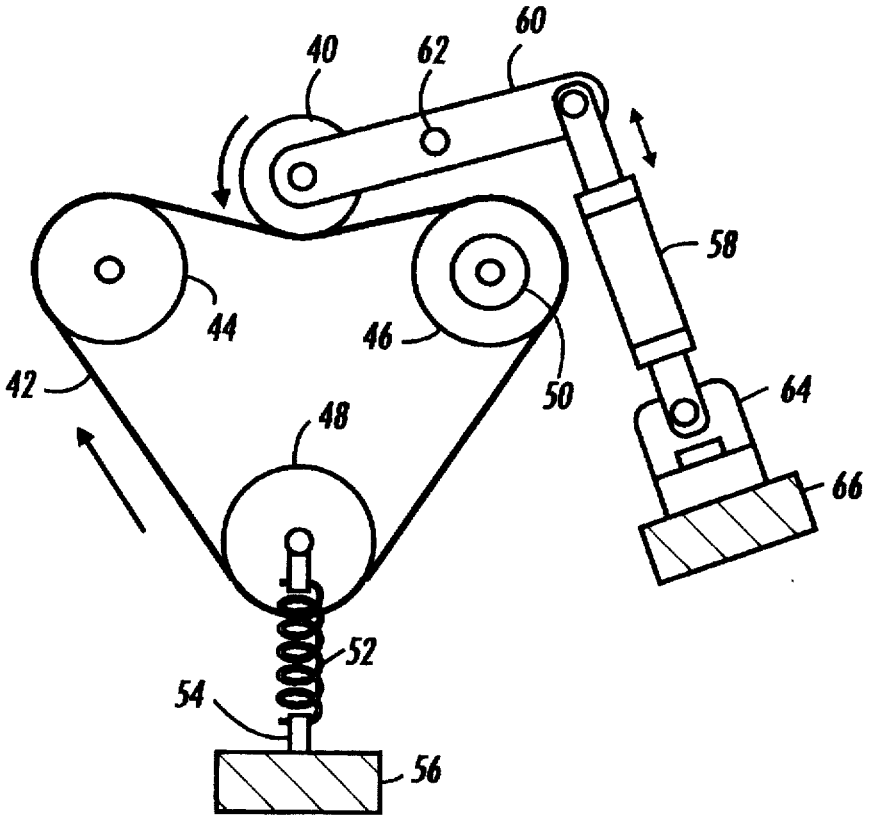
FIG. 2 is a schematic front elevation view of a contact cleaner belt system used to clean a cylinder.

FIG. 2 illustrates another contact cleaner belt system embodiment of this invention. The web processing apparatus includes a cylinder 40 rotating counterclockwise in pressure contact with a contact cleaning belt 42 supported a series of rollers 44, 46 and 48 which, in turn, have shafts supported on a frame (not shown). The contact cleaner belt 42 is a flexible polymer film coated with a polymer for a tacky surface. The tacky surface of the contact cleaner belt 42 is in synchronized moving contact with the outer surface of the moving cylinder 40, to remove dirt particles of contamination from the outer surface of cylinder 40 as it is pressed against the particles. Depending upon the amount of rotational friction encountered with rollers 44, 46 and 48, speed match drive motor 50 may be used to ensure synchronized moving contact of contact cleaning belt 42 with cylinder 40. Relative slippage between the contacting surfaces of cylinder 40 and contact cleaning belt 42 should be avoided. Tension may be applied to belt 42 by a pair of coil springs 52 (only one being shown) one end of each being secured to one end of the axial shaft of roller 48 and the other end of each being secured to a retaining flange 54 anchored to frame 56. Springs 52 allow contact cleaning belt 42 to partially wrap around the outer surface of cylinder 40 to enhance cleaning by increasing the area of actual contact between contact cylinder 40 and cleaning belt 42 during cleaning and by increasing the duration of contact between contact cylinder 40 and cleaning belt 42. Removal of springs 52 by unhooking an end from retaining flange 54 facilitates removal or replacement of contact cleaning belt 42. Cylinder 40 may be brought into contact or moved out of contact from contact cleaning belt 42 activation or inactivation of two-way acting air cylinder 58. Activation of two-way acting air cylinder 58 which pivots arm 60 counterclockwise around pin 62 to move cylinder 40 downwardly into pressure contact with contact cleaning belt 42. Pin 62 is supported by a frame (not shown) and two-way acting air cylinder 58 is supported by flange 64 which is secured to the frame 66. Two-way acting cylinder 58 is activated and inactivated by a conventional air and valving source (not shown). Inactivation of two-way acting air cylinder 58 causes arm 60 to rotate clockwise to lift cylinder 40 away from contact cleaning belt 42 to facilitate removal of a cleaned cylinder and for mounting of a fresh cylinder to be cleaned.

Figure 3:
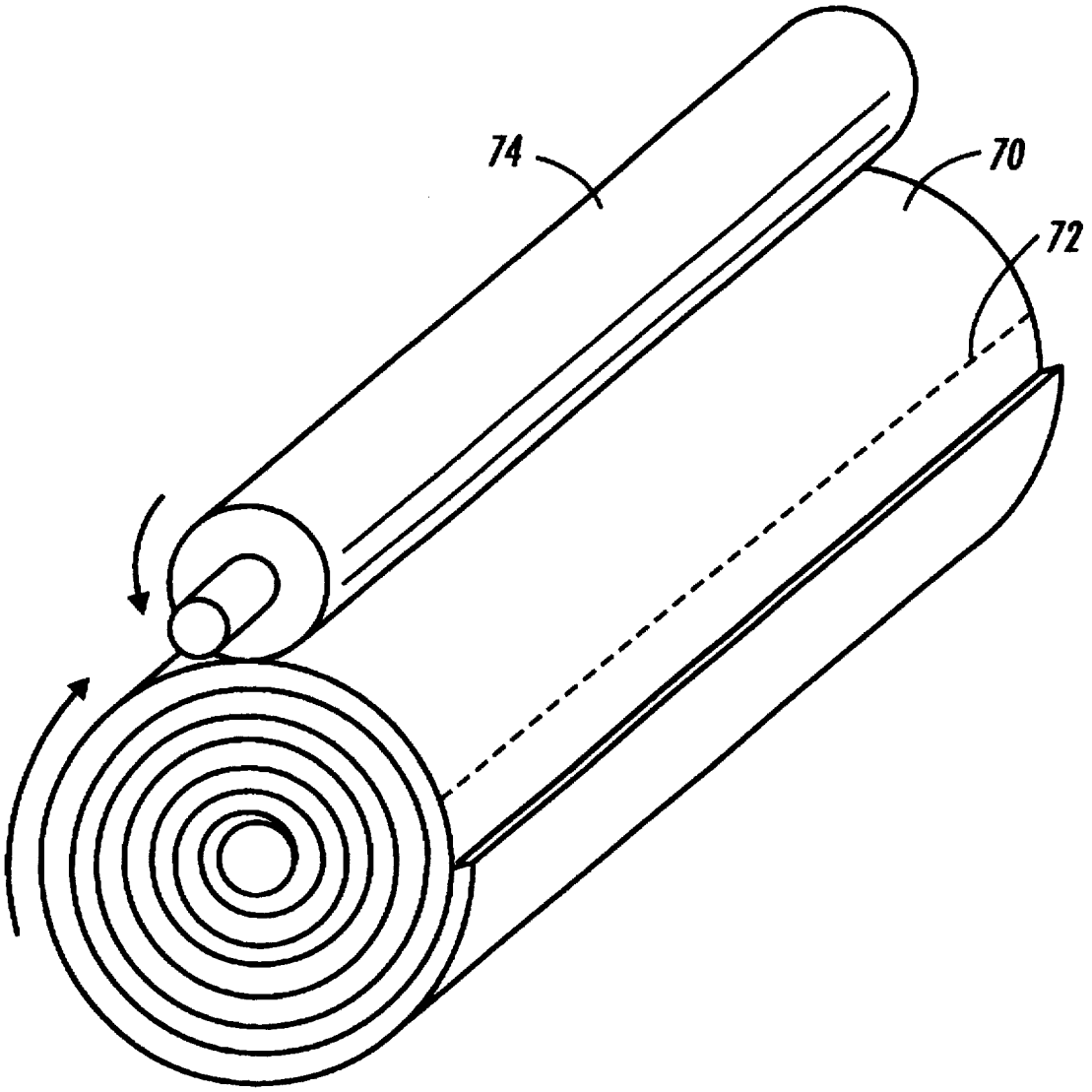
FIG. 3 is a schematic isometric view of a rolled contact cleaning web used to clean a cylinder.

In FIG. 3, a contact cleaning web rolled up into the shape of a cylindrically shaped contact cleaning web 70 is illustrated. Cylindrically shaped contact cleaning web 70 may be supported on an axial shaft mounted for rotation in a frame (not shown). The contact cleaning web contains a plurality of rows (only one row is weakened narrow transverse strip 72 extending from substantially one longitudinal edge of the web to the other, each row being spaced from the adjacent row by a distance substantially equal to the circumference of cylindrically shaped contact cleaning web 70. The weakened narrow transverse strip may comprise any suitable configuration such as a row of perforations, each perforation being circular, slotted or the like. Alternatively, the weakened narrow transverse strip may comprise a shallow slit which only partially extends through the thickness of the contact cleaning web. The weakened narrow transverse strip facilitates the tearing off of a contaminated section to expose and fresh underlying contact cleaning surface. Since the circumference of cylindrically shaped contact cleaning web 70 becomes shorter as contaminated sections of the contact cleaning web are removed, the distances between adjacent transverse strip 72 are preferably shorter. Alternatively, the distances between each adjacent transverse strip 72 can be a constant distance that is at least as great as the largest circumference of cylindrically shaped contact cleaning web 70 to ensure that the entire exposed surface of cylindrically shaped contact cleaning web 70 is made up of fresh uncontaminated material after an overlying contaminated section is removed. In FIG. 3, cylindrically shaped contact cleaning web 70 is shown in synchronized moving contact with the outer surface of a cylinder 74 to remove dirt particles. In this embodiment, the axis of cylinder 74 is parallel to the axis of cylindrically shaped contact cleaning web 70. Cylinders, such as cylinder 74, that are cleaned by cylindrically shaped contact cleaning web 70 may be selected from any suitable cylindrical member such as a transport roll, an electrostatographic imaging drum substrate, a coating applicator roll, a contact cleaning roll, an extrusion die backing roll, and the like. Since cylindrically shaped contact cleaning web 70 can be easily rejuvenated in place, it need not be taken out of service for rejuvenation.

Figure 4:
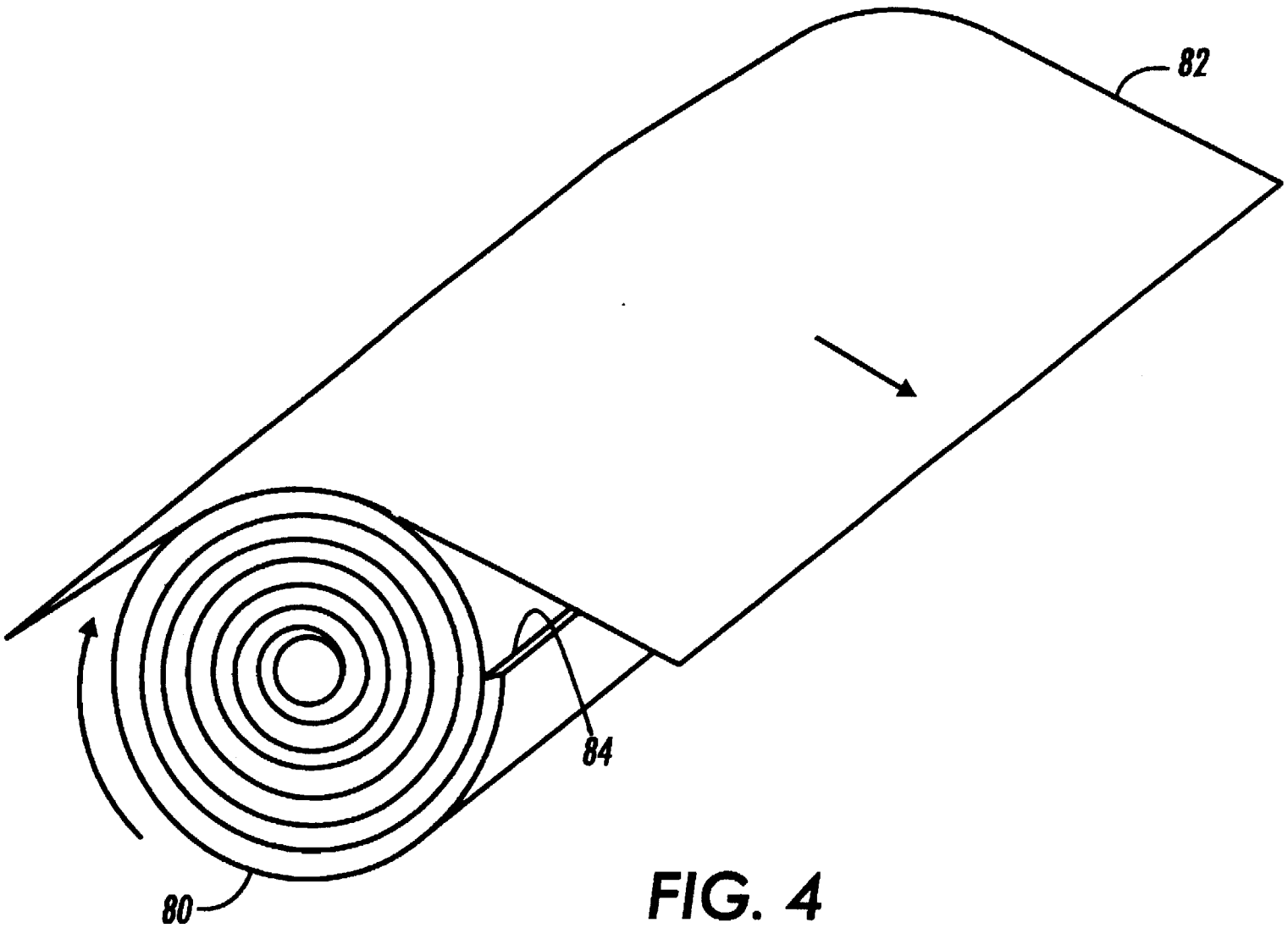
FIG. 4 is a schematic isometric view of a rolled contact cleaning web used to clean a web.

Illustrated in FIG. 4 is a contact cleaning web rolled up into the shape of a contact cleaning cylinder 80 in a manner similar to cylinder 70 shown in FIG. 3. However, instead of being used to clean a cylindrically shaped member, contact cleaning cylinder 80 is employed to clean a web 82. It is preferred that where web 82 is ultimately transversely cut into sections for various end uses, such as a welded photoreceptor belt, the circumference of cylinder 80 is selected to match the length of the cut sections (measured along the direction of travel). This aligns the exposed edge 84 of the rolled web in cylinder 80 with the region where web 82 will be severed. Such alignment is desirable where the cleaning effectiveness at the exposed edge 84 is less than that in other regions of the exposed surface of cylinder 80.

Figure 5:
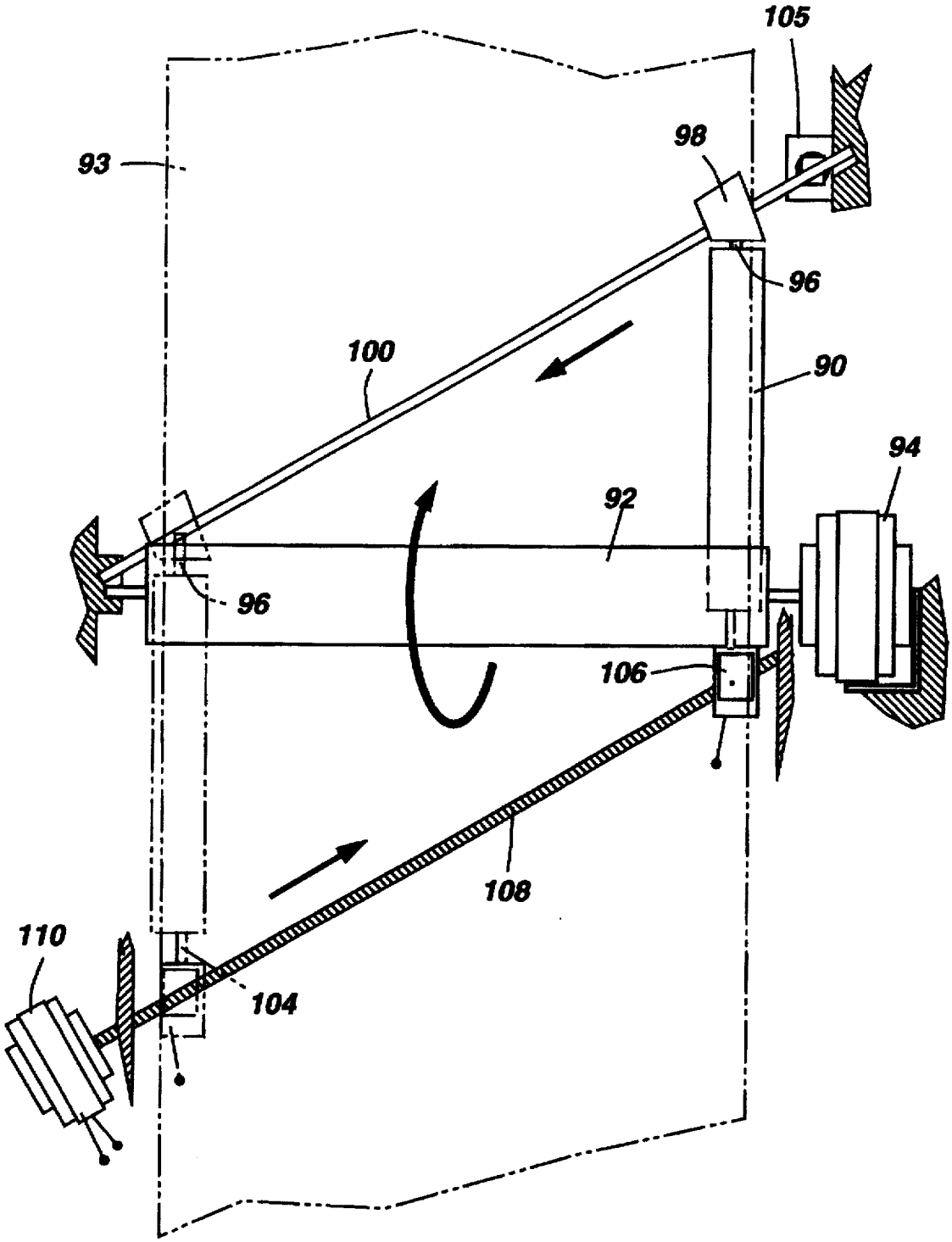
FIG. 5 is a schematic bottom view of a cleaning system embodiment where a web is cleaned by a contact cleaning roll which in turn is cleaned by a rolled contact cleaning web.

In FIG. 5, a contact cleaning web is illustrated rolled up into the shape of a contact cleaning cylinder 90 in a manner similar to cylinders 70 and 80 shown in FIGS. 3 and 4, respectively. However, instead of having an axis that is perpendicular to the direction of travel of the object being cleaned, the axis of cylinder 90 is positioned at an angle of between about 88 degrees and about 30 degrees to the axis of the driven cylinder 92 being cleaned so that the contact line between the two cylinders forms a continuous spiral along cleaning roll 90, exposing a fresh surface on each rotation. This arrangement promotes a scrubbing action to occur between the outer surface of cylinder 90 and and the outer surface of cylinder 92. A scrubbing action can enhance removal of stubbornly clinging dirt particles such as dirt particles clinging to another cleaning roll. Thus, for example, where cylinder 92 is itself a contact cleaning roll with a low tack outer surface contaminated with dirt particles removed from web 93, contact cleaning cylinder 90 should have a medium or high tack outer surface which is tackier than the outer surface of cylinder 92. A scrubbing action between the outer surface of cylinder 90 and and the outer surface of cylinder 92 further facilitates transfer of dirt particles from contact cleaning cylinder 92 to contact cleaning cylinder 90. In addition, since contact cleaning cylinder 92 is driven by speed match drive motor 94, the rotational energy imparted to contact cleaning cylinder 92 is partially transferred by rubbing contact cylinder 90 and drives cylinder 90 from the right edge of web 93 as illustrated in FIG. 5 diagonally downward to the left edge (this latter position shown by phantom lines). To facilitate travel of cylinder 90 from the right edge of web 93 to the left edge, axial shaft 96 at the upper end of cylinder 90 is supported in a guide rod block 98 which in turn is slidably mounted on a pair of parallel guide rods 100 and 102 (see FIG. 6). A solenoid/mounting block 105 supports guide rods 100 and remains inactivated while the cylinder 90 is on the right hand side as shown in FIG. 5. Axial shaft 104 at the lower end of cylinder 90 is supported in a pin follower block 106 containing a solenoid to reciprocate the pin (not shown). Pin follower block 106 is supported on lead screw 108 which is rotated by lead screw motor 110 when cylinder 90 reaches the left hand side as shown by the phantom lines in FIG. 5.

Figure 6:
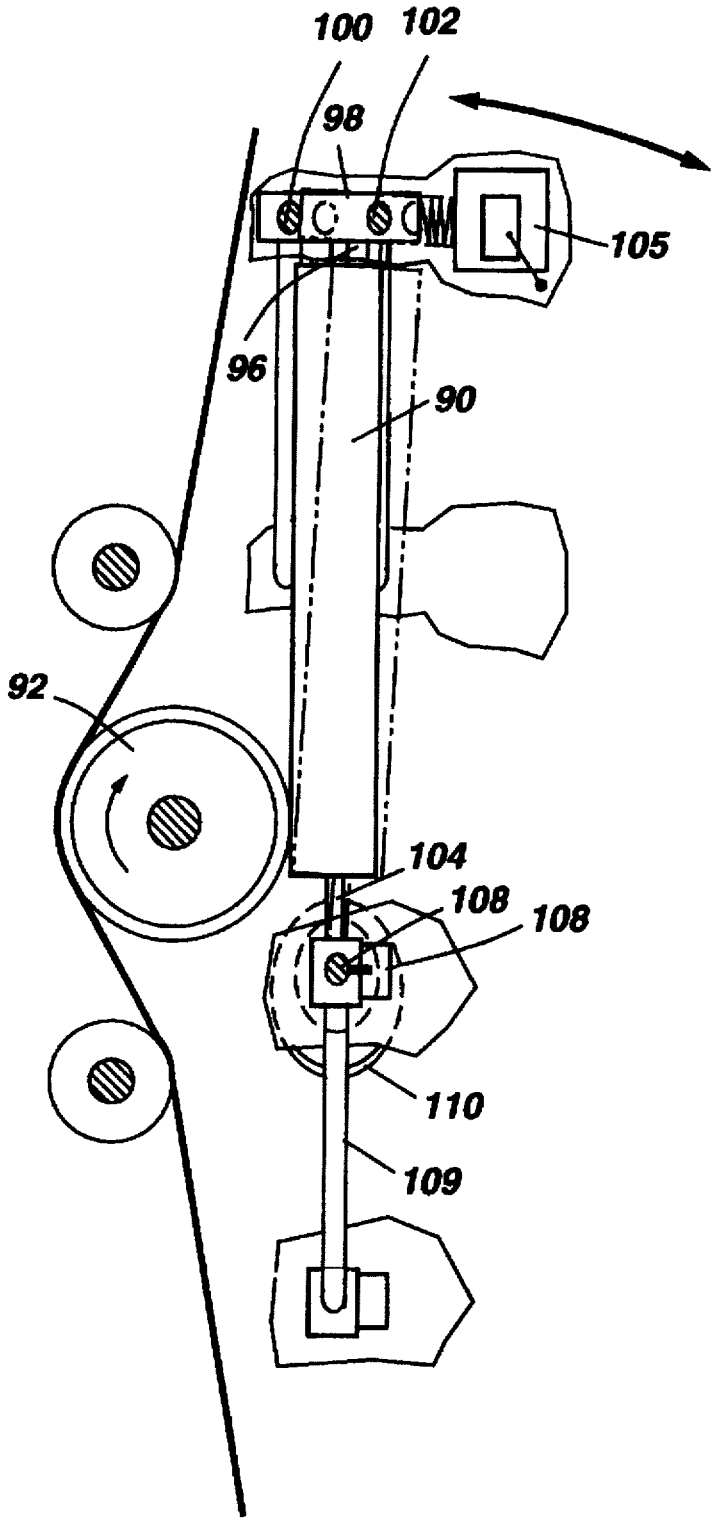
FIG. 6 is a schematic end view of the cleaning system of FIG. 5.

In operation, when cylinder 90 is on the right hand side as shown in FIGS. 5 and 6, solenoid/mounting block 105 remains inactivated and is spring biased against guide rod block 98 thereby urging cylinder 90 against cylinder 92. The solenoid in pin follower block 106 is activated to withdraw the pin from the lead screw 108 thereby allowing pin follower block 106 and cylinder 90 to slide freely on lead screw 108. Rotation of contact cleaning cylinder 92 by speed match drive motor 94 and frictional contact with cylinder 90 drives cylinder 90 from the right edge of web 93 as illustrated in FIG. 5 diagonally downwardly to the left edge (see phantom lines). Upon reaching the left edge, solenoid/mounting block 105 is activated which allows cylinder 90 to drop away against from cylinder 92 (shown by the phantom lines in FIG. 6). Almost simultaneously, the solenoid in pin follower block 106 is inactivated to insert the pin into lead screw 108 thereby allowing pin follower block 106 to be driven by lead screw 108. Lead screw motor 110 is activated to drive pin follower block 106 and cylinder 90 back to the original position shown in FIG. 5. If desired, solenoid can remain activated to allow a time delay prior to initiation of another cleaning cycle. As cylinder 90 travels from right to left in FIG. 5 while in contact with cylinder 92, the region of contact between cylinder 90 and cylinder 92 changes because both cylinders are simultaneously rotating. This region of contact follows a spiral path around each cylinder and traverses the outer surface of each cylinder from one end of each cylinder to the other to ensure that the entire outer surface of cylinder 92 receives a cleaning treatment. Activation and inactivation of the solenoids and motors may be accomplished by any suitable means such as conventional automatic controls, programmable computers and the like. The relative angle between the rollers can be adjusted so that the entire surface of roll 92 is contacted to provide optimal cleaning. This optimal angle will depend on the contact area which depends on the hardness of the rollers and the contact pressure.

The system of this invention comprises contact cleaner webs which clean both web and cylindrical members. These contact cleaner webs are particularly effective for cleaning webs after unwinding the web substrate from a supply roll, prior to application of coating, after drying of a coating, subsequent to slitting of the web substrate, prior to winding the web substrate on a take up roll, or at any other suitable stage in the fabrication and processing of an electrostatographic imaging web substrate. Optimum results for cleaning electrostatographic imaging web substrates are achieved when an electrostatographic imaging web substrate is cleaned with the cleaning system of this invention prior to and subsequent to the application of an electrically conductive layer, a charge blocking layer, an optional adhesive layer, a charge generating layer, a charge transport layer and optional overcoating layer. Generally, after a web substrate is coated with the charge blocking layer and adhesive layer, the coated web substrate is rolled up into a roll and transported to another coating station. During unrolling of the coated web, static electricity is generated as the outermost ply of the coated web is separated from the roll. Since this static electricity tends to attract dirt particles to the exposed surfaces of the web, the web is preferably cleaned again prior to application of a charge generating layer. After drying of the charge generating layer, the coated surface is preferably cleaned prior to application of the charge transport layer. In some embodiments, the charge transport layer is deposited on the web or drum prior to the charge generating layer. The contact cleaning systems of this invention may also be utilized to clean a web prior to and/or subsequent to the application of a bar code. Further, the web may be cleaned with the contact cleaning system of this invention prior to and subsequent to the application an anti-curl backing layer to the rear surface of the coated web. Similarly, the contact cleaning webs of this invention may be utilized for contact cleaning of electrostatographic drum substrates prior to and after formation of the various dried coating layers utilized in drum type electrostatographic imaging members.

If desired, a plurality of contact cleaning web surfaces are sequentially brought into contact with a surface of the electrostatographic imaging member substrate to be cleaned. This arrangement promotes improved cleaning, particularly where dirt accumulates on a particular region on the first contact cleaning web belt as it repeatedly contacts the substrate during roll rotation. Accumulation of dirt on a specific region of a single cycling contact cleaning belt or rolled contact cleaning web can eventually lead to the formation of a repeating pattern of poorly cleaned regions on the substrate during the cleaning process because of the reduced cleaning effectiveness of the contaminated regions on the cycling contact cleaning member.

Generally, synchronous contact between the contact cleaning member and the surface to be cleaned is preferred to prevent any scrubbing action which can remove material of either the contact cleaning member or the surface to be cleaned. This prevents the formation of scratches on either the surface of contact cleaning member or the surface of the substrate to be cleaned. Synchronous speeds may be achieved by any suitable technique such as separate synchronized motor drives for the member being cleaned and the contact cleaning member. Alternatively, either the web being cleaned or the contact cleaning member can be driven by the other by frictional contact. Also, an electrostatographic imaging member web substrate is preferably maintained under tension by conventional means such as supply roll brakes, spring loaded idler rolls and the like to ensure pressure contact with the contact cleaning member surface during cleaning.

The contact cleaning surface may comprise a deposited coating on a supporting film or it may make up the entire cleaning member. A soft conformable contact cleaning material at the surface of the cleaning member is preferred to ensure greater surface area of contact between the contact cleaning surface and the dirt particles than between the dirt particles and the electrostatographic imaging web substrate. Thus, the durometer of the contact cleaning material is preferably less than the durometer of the materials in the electrostatographic imaging web substrate.

There does not appear to be any criticality in the diameter of a contact cleaning belt or rolled web. However, smaller diameter contact cleaning rolls or rolled webs have less surface available for accumulating dirt particles and tend to become overly dirty more rapidly. It may be preferable to have the cleaning belt or rolled web be a different circumference than any rollers cleaned in the cleaning process to aid in troubleshooting repeat defects.

Any suitable tacky cleaning material may be used on the contact cleaning webs or rolled cleaning webs of this invention. Typical tacky cleaning materials include the medium tack materials utilized in "Post-it®" sheets available from the 3M Company. A square test sample having a width of about 5 centimeters of paper coated with medium tack materials such as employed in Post-it® type adhesives will stick to a human finger when the finger is pressed against the adhesive surface and thereafter lifted. These test samples will retain a dirt particle having an average particle size of between about 0.5 micrometer and about 100 micrometers when the test sample is pressed against the particle and lifted away from any smooth surface upon which the dirt particle originally rested. This test defines the expression "medium tact surface" as employed herein. Tacky materials employed in the medium tact coating are believed to contain tacky polymeric elastomeric alkyl acrylate or alkyl methacrylate ester material. Typical medium tact materials are disclosed, for example, in U.S. Pat. No. 4,994,322, the entire disclosure thereof being incorporated herein by reference.

The tacky rubber materials utilized in the contact cleaning members of this invention can have a low tack. The expression "low tact" as employed herein is defined as a tacky surface to which dirt particles having a size less than about 100 micrometers adhere, but to which a human finger does not adhere. Thus, a square test sample piece having a thickness of about 2 millimeters and a width of about 1 centimeter can not be picked up when a human finger is pressed down against the sample and thereafter lifted. However, when the test sample is pressed against a dirt particle having an average particle size of between about 0.5 micrometer and about 100 micrometers, the dirt particle will adhere to the test sample when the test sample is lifted away from any smooth surface upon which the dirt particle originally rested. The low tact materials utilized in the contact cleaning webs of this invention may comprise any suitable adhesive material. Typical low tact materials include, for example, polyurethane, natural rubber, and the like. A typical low tact rubbery cross-linked polyurethane material is available from Polymag, Rochester, N.Y. and R. G. Egan, Rochester, N.Y. The low tact rubbery cross-linked polyurethane material has a durometer of about 15–35 Shore A. Low tact rubbery cross-linked polyurethane materials are described in U.S. Pat. No. 5,102,714 and U.S. Pat. No. 5,227,409, the entire disclosures thereof being incorporated herein by reference.

If a rugged surface such as a solid metal transport roller is cleaned with the contact cleaning web of this invention, a high tack material may be employed in the contact cleaning web of this invention because there is no danger of damaging the surface. This is quite different from cleaning a fragile surface such as a thin coating having poor adhesion to an underlying substrate. A typical high tack material is the material utilized in Scotch Brand adhesive tapes such as Magic® adhesive tape available from 3M Company. Other typical high tack adhesives include, for example, rubbber cement, and the like.

The amount of adhesion of the contact cleaning surface to the surface of any coated substrates during contact cleaning should be less than the peel strength of any coating being cleaned to ensure that when the contact cleaning surface is separated from the surface being cleaned, the coating remains undamaged on the substrate. Since the peel strength of coatings on the substrate varies with the type of materials employed in the substrate and in coating, the amount of tack exerted by a contact cleaning member can vary depending upon the specific materials employed in substrate and coating. For example, a low tack contact polyurethane contact cleaning member surface is preferred for cleaning substrates vacuum coated with thin metalized coatings, e.g. aluminized polyethylene terephthalate films. Low tack is also desirable for cleaning a low peel strength adhesive layer on a photoreceptor substrate to prevent removal of the adhesive coating when the contact cleaning surface is separated from the adhesive layer. However, the amount of tackiness on a contact cleaning member surface should also be sufficient to remove particles having an average particle size between about 0.5 micrometer and about 100 micrometers when the contact cleaning surface is separated from the surface being cleaned.

Preferably, the color of the contact cleaning surface is different from the color of the dirt removed from the surface to be cleaned to provide contrast between the color of the dirt particles and the color of the contact cleaning surface. This facilitates determination of when the contact cleaning rolls should be cleaned or replaced and where the dirt particles are located on the contact cleaning surface.

Both the contact cleaning surface of the webs of this invention and the electrostatographic imaging member web substrate to be cleaned should be sufficiently smooth to ensure contact between the contact cleaning surface and the dirt particles on the surface to be cleaned. Thus, the contact cleaning surface should be continuous. The contact cleaning surface should also not form any deposits on the surface of the electrostatographic imaging member to be cleaned because such deposits may adversely affect the electrical properties of the final electrostatographic imaging member.

Generally, a contact or wrap angle between a web being cleaned and an arcuate surface of a contact cleaning web or rolled contact cleaning web of more than about 60° of arc measured in the direction of travel is preferred because this ensures maximum contact, even tension and also ensures uniform roller to web speed. It also provides adequate contact time for particles to adhere to the cleaning roll. Angles less than about 60 degrees may result in slippage and inefficient cleaning for embodiments where contact cleaning web is transported in an accurate path such as around part of a backing roll or when the contact cleaning web is wound into a cylindrical shape. However, for some embodiments utilizing a contact cleaning web, one can increase contact time with a flat surface to be cleaned by using flat backing plates behind the contact cleaning web.

Large particles of dirt clinging to a contact cleaning member surface can emboss or even scratch a surface to be cleaned as the contact cleaning surface is cycled around a fresh surface to be cleaned. This can occur on a cycling contact cleaning belt or rotating rolled contact cleaning web. Thus, it is desirable that any large dirt particles have an average particle size of larger than about 100 micrometers be removed prior to bringing a contact cleaning surface into contact with the surface to be cleaned. Such removal of these relatively large particles also ensures that particles are not present to mask smaller underlying particles during subsequent contact cleaning. Any suitable technique such as air jet cleaning, vacuum cleaning, air impingement, ultrasonic resonation, and the like and combinations thereof may be utilized to remove particles having an average particles size greater than at least 100 micrometers.

Although a specific cleaning technique and apparatus are shown in the figures, any other suitable cleaning technique may be utilized to clean the contact cleaning members. The cleaning technique selected depends upon the type of dirt particles picked up by the cleaning member surfaces. Any liquid cleaning material utilized to clean off the contact cleaning member surface is preferably selected from materials that do not dissolve the dirt particles. Dissolving of the accumulated dirt particles can lead to absorption of the dirt into the surface of the contact cleaning member and can also lead to breakdown of the cleaning effectiveness of the contact cleaning surface. Satisfactory results have been achieved with cleaning materials comprising a mixture of water and alcohol. Typical alcohols include, for example, methanol, ethanol, isopropyl alcohol and the like. Generally, the mixture comprises between about 75 percent and about 99 percent by weight water and between about 1 percent and about 25 percent by weight alcohol. The preferred concentration comprises between about 78 and about 82 percent by weight water and between about 18 and about 22 percent alcohol.

When cleaning of the contact cleaning surface becomes less effective and where the thickness of the contact cleaning material is adequate, some of the surface of the contact cleaning surface may be ground or ablated away to remove any embedded dirt present and to also remove some of the ineffective contact cleaning material thereby exposing fresh contact cleaning material.

Preferably, cleaning and coating operations for fabricating electrostatographic imaging members are conducted under clean room conditions such as those at least meeting the requirements of a Class 1000 Clean Room. A Class 1000 Clean Room is defined as a room where each one cubic foot volume of space does not have a particle count of more than 1000. If desired, more stringent clean room conditions may be utilized. However, for very large coating operations occupying a large volume of space, more stringent cleaning room conditions are more difficult and more expensive to achieve.

Electrostatographic flexible web imaging members are well known in the art. Typical electrostatographic flexible web imaging members include, for example, photoreceptors for electrophotographic imaging systems and electroceptors or ionographic members for electrographic imaging systems.

Electrostatographic flexible web imaging members may be prepared by various suitable techniques. Typically, a flexible web substrate is provided having an electrically conductive surface. For electrophotographic imaging members, at least one photoconductive layer is then applied to the electrically conductive surface. A charge blocking layer may be applied to the electrically conductive layer prior to the application of the photoconductive layer. If desired, an adhesive layer may be utilized between the charge blocking layer and the photoconductive layer. For multilayered photoreceptors, a charge generation binder layer is usually applied onto the blocking layer and charge transport layer is formed on the charge generation layer. For ionographic imaging members, an electrically insulating dielectric layer is applied to the electrically conductive surface.

The substrate may be opaque or substantially transparent and may comprise numerous suitable materials having the required mechanical properties. Accordingly, the substrate may comprise a layer of an electrically non-conductive or conductive material such as an inorganic or an organic composition. As electrically non-conducting materials there may be employed various resins known for this purpose including polyesters, polycarbonates, polyamides, polyurethanes, and the like which are flexible as thin webs. The electrically insulating or conductive substrate should be flexible and in the form of an endless flexible belt. The substrate may consist of individually created seamless belts or welded pieces of a longer web. Preferably, the endless flexible belt shaped substrate comprises a commercially available biaxially oriented polyester known as Mylar, available from E. I. du Pont de Nemours & Co. or Melinex available from ICI.

The thickness of the web substrate layer depends on numerous factors, including beam strength and economical considerations, and thus this layer for a flexible web may be of substantial thickness, for example, about 125 micrometers, or of minimum thickness less than 50 micrometers, provided there are no adverse effects on the final electrostatographic device. In one flexible web embodiment, the thickness of this layer ranges from about 65 micrometers to about 150 micrometers, and preferably from about 75 micrometers to about 100 micrometers for optimum flexibility and minimum stretch when cycled as a belt around small diameter rollers, e.g. 19 millimeter diameter rollers. The surface of the substrate layer is preferably cleaned prior to coating to produce higher quality coatings. Cleaning is preferably effected with the cleaning system of this invention.

The conductive layer may vary in thickness over substantially wide ranges depending on the optical transparency and degree of flexibility desired for the electrostatographic member. Accordingly, for a flexible photoresponsive web imaging device, the thickness of the conductive layer may be between about 20 angstrom units to about 750 angstrom units, and more preferably from about 100 Angstrom units to about 200 angstrom units for an optimum combination of electrical conductivity, flexibility and light transmission. The flexible conductive layer may be an electrically conductive metal or metal alloy layer formed, for example, on the substrate by any suitable coating technique, such as a vacuum depositing technique. Typical metals include aluminum, zirconlure, niobiurn, tantalum, vanadium and hafnium, titanium, nickel, stainless steel, chromium, tungsten, molybdenurn, and the like. Typical vacuum depositing techniques include sputtering, magnetron sputtering, RF sputtering, and the like. Regardless of the technique employed to form the metal layer, a thin layer of metal oxide forms on the outer surface of most metals upon exposure to air. Thus, when other layers overlying the metal layer are characterized as "contiguous" layers, it is intended that these overlying contiguous layers may, in fact, contact a thin metal oxide layer that has formed on the outer surface of the oxidizable metal layer.

After formation of an electrically conductive surface, a hole blocking layer may be applied thereto for photoreceptors. Generally, electron blocking layers for positively charged photoreceptors allow holes from the imaging surface of the photoreceptor to migrate toward the conductive layer. Any suitable blocking layer capable of forming an electronic barrier to holes between the adjacent photoconductive layer and the underlying conductive layer may be utilized. Blocking layers are well known in the art and typical blocking layer materials are disclosed, for example, in U.S. Pat. Nos. 4,291,110, 4,338,387, 4,286,033 and 4,291,110, the disclosures of which are incorporated herein in their entirety. A preferred blocking layer comprises a reaction product between a hydrolyzed silane and the oxidized surface of a metal ground plane layer. The blocking layer may be applied by any suitable conventional technique such as spraying, dip coating, draw bar coating, gravure coating, silk screening, air knife coating, reverse roll coating, vacuum deposition, chemical treatment and the like. For convenience in obtaining thin layers, the blocking layers are preferably applied in the form of a dilute solution, with the solvent being removed after deposition of the coating by conventional techniques such as by vacuum, heating and the like. The blocking layer should be continuous and have a thickness of less than about 0.2 micrometer because greater thicknesses may lead to undesirably high residual voltage.

An optional adhesive layer may applied to the hole blocking layer. Any suitable adhesive layer well known in the art may be utilized. Typical adhesive layer materials include, for example, polyesters, dupont 49,000 (available from E.I. dupont de Nemours and Company), Vitel PE100 (available from Goodyear Tire & Rubber), polyurethanes, and the like. Satisfactory results may be achieved with adhesive layer thickness between about 0.05 micrometer (500 angstroms) and about 0.3 micrometer (3,000 angstroms). Conventional techniques for applying an adhesive layer coating mixture to the charge blocking layer include spraying, dip coating, roll coating, wire wound rod coating, gravure coating, Bird applicator coating, and the like. Drying of the deposited coating may be effected by any suitable conventional technique such as oven drying, infra red radiation drying, air drying and the like.

Any suitable photogenerating layer may be applied to the adhesive blocking layer which can then be overcoated with a contiguous hole transport layer as described hereinafter. Typical photogenerating layer comprise inorganic or organic photoconductive pigment particles dispersed in a film forming binder as is well known in the art. Any suitable polymeric film forming binder material may be employed as the matrix in the photogenerating binder layer. Typical polymeric film forming materials include those described, for example, in U.S. Pat. No. 3,121,006, the entire disclosure of which is incorporated herein by reference.

The photogenerating composition or pigment is present in the resinous binder composition in various amounts, generally, however, from about 5 percent by volume to about 90 percent by volume of the photogenerating pigment is dispersed in about 10 percent by volume to about 95 percent by volume of the resinous binder, and preferably from about 20 percent by volume to about 30 percent by volume of the photogenerating pigment is dispersed in about 70 percent by volume to about 80 percent by volume of the resinous binder composition. In one embodiment about 8 percent by volume of the photogenerating pigment is dispersed in about 92 percent by volume of the resinous binder composition.

The photogenerating layer containing photoconductive compositions and/or pigments and the resinous binder material generally ranges in thickness of from about 0.1 micrometer to about 5.0 micrometers, and preferably has a thickness of from about 0.3 micrometer to about 3 micrometers. The photogenerating layer thickness is related to binder content. Higher binder content compositions generally require thicker layers for photogeneration. Thicknesses outside these ranges can be selected providing the objectives of the present invention are achieved.

Any suitable and conventional technique may be utilized to mix and thereafter apply the photogenerating layer coating mixture. Typical application techniques include spraying, dip coating, roll coating, wire wound rod coating, extrusion die coating, curtain coating, and the like. Drying of the deposited coating may be effected by any suitable conventional technique such as oven drying, infra red radiation drying, air drying and the like.

The active charge transport layer may comprise an activating compound useful as an additive dispersed in electrically inactive polymeric materials making these materials electrically active. These compounds may be added to polymeric materials which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer. An especially preferred transport layer employed in one of the two electrically operative layers in the multilayered photoconductor of this invention comprises from about 25 percent to about 75 percent by weight of at least one charge transporting aromatic amine compound, and about 75 percent to about 25 percent by weight of a polymeric film forming resin in which the aromatic amine is soluble.

Any suitable inactive resin binder soluble in a suitable solvent may be employed in the process of this invention and any suitable and conventional technique may be utilized to mix and thereafter apply the charge transport layer coating mixture to the charge generating layer. Typical application techniques include spraying, dip coating, roll coating, wire wound rod coating, extrusion die coating, curtain coating, and the like. Drying of the deposited coating may be effected by any suitable conventional technique such as oven drying, infra red radiation drying, air drying and the like.

Generally, the thickness of the hole transport layer is between about 10 to about 50 micrometers, but thicknesses outside this range can also be used. The hole transport layer should be an insulator to the extent that the electrostatic charge placed on the hole transport layer is not conducted in the absence of illumination at a rate sufficient to prevent formation and retention of an electrostatic latent image thereon. In general, the ratio of the thickness of the hole transport layer to the charge generator layer is preferably maintained from about 2:1 to 200:1 and in some instances as great as 400:1.

Examples of photosensitive members having at least two electrically operative layers include the charge generator layer and diamine containing transport layer members disclosed in U.S. Pat. Nos.4,265,990, 4,233,384, 4,306,008, 4,299,897 and 4,439,507, the disclosures of these patents being incorporated herein in their entirety. The photoreceptors may comprise, for example, a charge generator layer sandwiched between a conductive surface and a charge transport layer as described above or a charge transport layer sandwiched between a conductive surface and a charge generator layer.

Other layers such as conventional electrically conductive ground strip along one edge of the belt in contact with the conductive layer, blocking layer, adhesive layer or charge generating layer to facilitate connection of the electrically conductive layer of the photoreceptor to ground or to an electrical bias. Ground strips are well known and usually comprise conductive particles dispersed in a film forming binder.

Optionally, an overcoat layer may also be utilized to improve resistance to abrasion. In some cases an anti-curl back coating may be applied to the side opposite the photoreceptor to provide flatness and/or abrasion resistance. These overcoating and anti-curl back coating layers are well known in the art and may comprise thermoplastic organic polymers or inorganic polymers that are electrically insulating or slightly semiconductive. Overcoatings are continuous and generally have a thickness of less than about 10 micrometers. The thickness of anti-curl backing layers should be sufficient to substantially balance the total forces of the layer or layers on the opposite side of the supporting substrate layer. A thickness between about 5 and about 50 micrometers is a satisfactory range for flexible web photoreceptors.

Most of the layers described above can also be applied to drum substrates. Thus, the contact cleaning system of this invention is also applicable to cleaning a drum surface before application of a coating or after a dried coating has been formed.

For electrographic imaging members, a dielectric layer overlying the conductive layer may be substituted for the photoconductive layers. Any suitable, conventional, flexible, electrically insulating dielectric polymer may be used in the dielectric layer of the electrographic imaging member.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure above and as pointed out hereinafter.

EXAMPLE I

A cleaning belt was created by joining the ends of a three inch wide piece of 3M book tape, product number 845, to form an endless belt with the adhesive out. The tape was placed into contact with a dirty contact cleaning roll, four inches in diameter, comprising a metal core around which was molded a polyurethane rubber layer having a thickness of 13 mm. The polyurathane rubber layer was a low tack rubbery cross linked polyurethane material having a durometer of about 22 shore A, available from R. G. Egan, Rochester, N.Y. The high tack surface of the experimental cleaning web removed the majority of the particulates from the cleaning roll resulting in a renewed cleaning surface that could be used to clean photoreceptor substrates. Sections of the prototype cleaning web were cut out and analyzed using optical microscopes and electron microscopes to characterize the removed particulates. The cleaning web samples can be laid flat which facilitates defect analysis. The normal cleaning procedure uses a moist cloth wiper which concentrates the defects and makes subsequent identification difficult. The high tack cleaning web preserves the individual partticulate identity and location allowing determinination of spacing of repeat defects.

EXAMPLE II

A cleaning belt was created by joining the ends of a three inch wide piece of 3M book tape, product number 845, to form an endless belt with the adhesive out. The tape was placed into contact with a dirty metal roller and moved along the surface until the entire circumference was contacted by a piece of the prototype cleaning belt. The dirt was removed by the cleaning belt. The cleaning web samples can be laid flat which facilitates defect analysis. The normal cleaning procedure uses a moist cloth wiper which concentrates the defects and makes subsequent identification difficult. The high tack cleaning web preserves the individual partticulate identity and location allowing determinination of spacing of repeat defects.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A cleaning system including:

a frame, a movable member having an outer surface to be cleaned, and a movable contact cleaner web supported by said frame and disposed for synchronous moving contact with said surface of said member while said surface is moving, said contact cleaner web comprising a polymer having a tacky outer surface which contacts said surface of said member.

2. A cleaning system according to claim 1 wherein said contact cleaning web is a continuous belt.

3. A cleaning system according to claim 1 wherein said movable member to be cleaned is a web.

4. A cleaning system according to claim 3 wherein said movable member comprises at least a film substrate having an outer surface to be cleaned selected from the group consisting of a thin vacuum deposited metal layer, a charge blocking layer, an adhesive layer, a charge generating layer and a charge transport layer.

5. A cleaning system according to claim 1 wherein said movable member to be cleaned is a cylinder.

6. A cleaning system according to claim 5 wherein said movable member to be cleaned comprises at a cylindrical substrate having an outer coating selected from the group consisting of a charge blocking layer, a charge generating layer and a charge transport layer.

7. A cleaning system according to claim 5 including means to bring said cylinder into contact with said movable contact cleaner web.

8. A contact cleaning system according to claim 1 wherein said contact cleaning web is rolled to form a cylindrical shape prior to synchronous moving contact with said moving surface of said member.

9. A contact cleaning system according to claim 8 wherein said contact cleaning web contains a plurality of rows of a weakened narrow transverse strip extending from substantially one longitudinal edge of said web to the other, said rows being spaced from an adjacent row by a distance substantially equal to the circumference of said cylindrical shape.

10. A contact cleaning system according to claim 8 including means to maintain the axis of said cylindrical shaped contact cleaning web substantially parallel to a cylindrically shaped member to be cleaned.

11. A contact cleaning system according to claim 8 including support means adapted to maintain the axis of said cylindrical shaped cleaning web at an angle to the axis of a cylindrically shaped member to be cleaned.

12. A contact cleaning system according to claim 11 wherein said cylindrically shaped member to be cleaned is a contact cleaning roll in contact with a web to be cleaned.

13. A contact cleaning system according to claim 11 including means to rotate said cylindrically shaped member to be cleaned whereby frictional contact between said cylindrically shaped member to be cleaned and said cylindrical shaped contact cleaning web drives said cylindrical shaped cleaning web from one end of said cylindrically shaped member to be cleaned to the opposite end.

* * * * *